US005243253A

United States Patent [19]

Marks et al.

[11] Patent Number: 5,243,253

[45] Date of Patent: Sep. 7, 1993

[54] COLOR PICTURE TUBE HAVING SHADOW MASK WITH IMPROVED TIE BAR GRADING

[75] Inventors: Bruce G. Marks; Thomas D. Welles, Jr., York; Andrew Good, Reamstown, all of Pa.

[73] Assignee: Thomson Consumer Electronics, Inc., Indianapolis, Ind.

[21] Appl. No.: 737,748

[22] Filed: Jul. 30, 1991

[51] Int. Cl.[5] ..... H01J 29/07

[52] U.S. Cl. ..... 313/402; 313/403

[58] Field of Search ..... 313/402, 403

[56] References Cited

U.S. PATENT DOCUMENTS 3,766,419 10/1973 Barbin ..... 313/403
4,227,115 10/1980 Elshof et al. ..... 313/403
5,030,881 7/1991 Marks et al. ..... 313/403

FOREIGN PATENT DOCUMENTS 0203636 4/1986 European Pat. Off. .
0049011 9/1991 European Pat. Off. .
1358811 7/1972 United Kingdom .
1450597 11/1973 United Kingdom .
1587881 8/1977 United Kingdom .

*Primary Examiner*—Donald J. Yusko
*Assistant Examiner*—Ashok Patel
*Attorney, Agent, or Firm*—Joseph S. Tripoli; Dennis H. Irlbeck

[57] ABSTRACT

An improved color picture tube includes a shadow mask which has a rectangular periphery with two long sides and two short sides. The mask has a major axis, which passes through the center of the mask and parallels the long sides, and a minor axis, which passes through the center of the mask and parallels the short sides. The mask includes slit-shaped apertures aligned in columns that essentially parallel the minor axis. Adjacent apertures in each column are separated by tie bars in the mask. The widths of the tie bars are graded in dimension. The grading is at least partially related to the amount of tie bar stretch occurring in a similar size mask having different tie bar widths.

1 Claim, 6 Drawing Sheets

TIE BAR GRADING IN A NOVEL FLAT SHADOW MASK (MILS)

TIE BAR GRADING IN A PRIOR ART FLAT SHADOW MASK (MILS)

TIE BAR GRADING IN A NOVEL FLAT SHADOW MASK (MILS)

COLOR PICTURE TUBE HAVING SHADOW MASK WITH IMPROVED TIE BAR GRADING

This invention relates to color picture tubes of a type having shadow masks with slit-shaped apertures, wherein the apertures are aligned in columns and the apertures in each column are separated by tie bars in the mask, and particularly to such a mask having an improved tie bar grading.

BACKGROUND OF THE INVENTION

A predominant number of color picture tubes in use today have line screens and shadow masks that include slit-shaped apertures. The apertures are aligned in columns, and the adjacent apertures in each column are separated from each other by webs or tie bars in the mask. Such tie bars are essential in the mask to maintain its integrity when it is formed into a dome-shaped contour which somewhat parallels the contour of the interior of a viewing faceplate of a tube. Tie bars in one column are offset in the longitudinal direction of the column (vertical direction) from the tie bars in the immediately adjacent columns.

When a mask is formed into a dome-shaped contour, the forming process stretches the tie bars in the mask. Such stretching is nonuniform throughout the mask because the forces on the mask during forming are nonuniform throughout the mask. This stretching of the webs has an adverse effect on the mask, in that the slit apertures in the mask are stretched beyond their desired sizes. Furthermore, sometimes when the mask is formed into its dome-shape, the tie bars tear, thus ruining the mask. Therefore, there is a need for some solution to the problem of tie bar stretching.

SUMMARY OF THE INVENTION

An improved color picture tube includes a shadow mask which has a rectangular periphery with two long sides and two short sides. The mask has a major axis, which passes through the center of the mask and parallels the long sides, and a minor axis, which passes through the center of the mask and parallels the short sides. The mask includes slit-shaped apertures aligned in columns that essentially parallel the minor axis. Adjacent apertures in each column are separated by tie bars in the mask. The widths of the tie bars are graded in dimension. The grading is at least partially related to the amount of tie bar stretch occurring in a similar size mask having different tie bar widths.

DETAILED DESCRIPTION OF THE PREFERRED EMBODIMENTS

Figure 1:
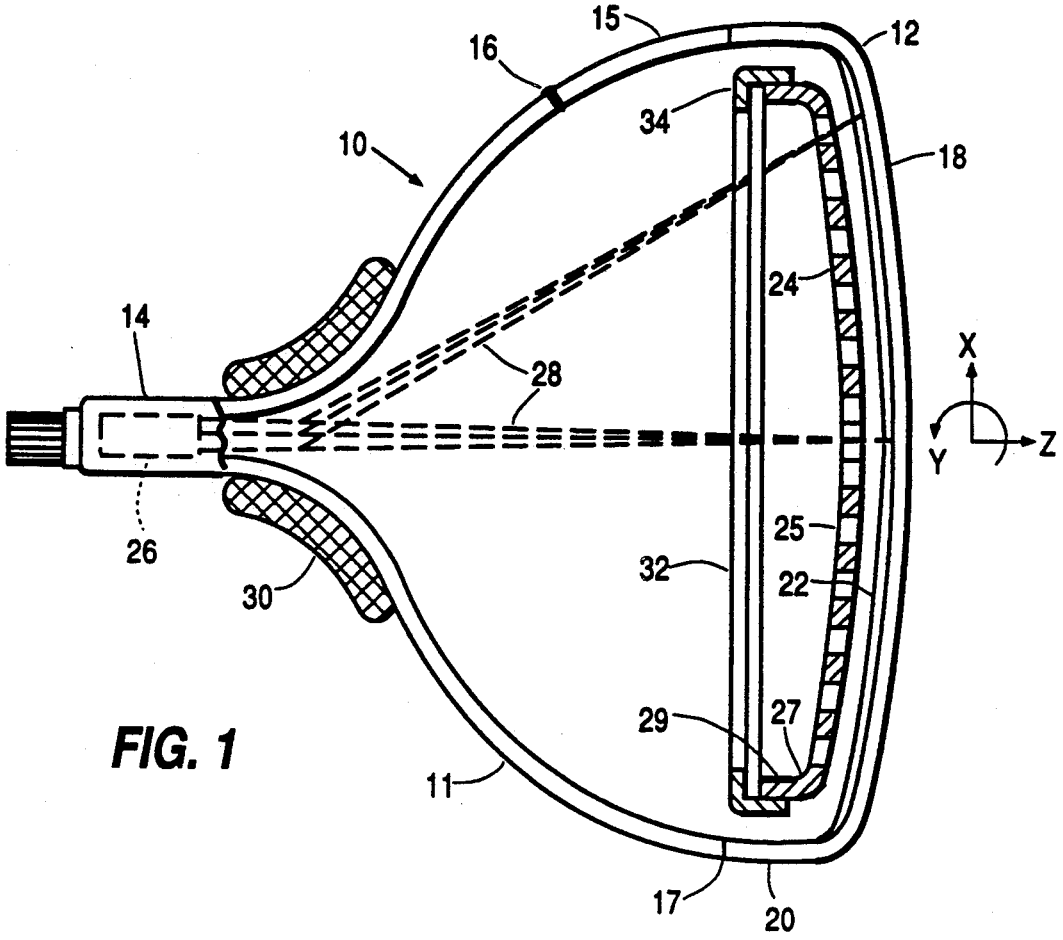
FIG. 1 is an axially sectioned side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1. The shadow mask 24 includes a curved apertured portion 25, an imperforate border portion 27 surrounding the apertured portion 25, and a skirt portion 29 bent back from the border portion 27 and extending away from the screen 22. The mask 24 is telescoped within (or alternatively over) the frame 34, and the skirt portion 29 is welded to the frame 34.

Figure 2:
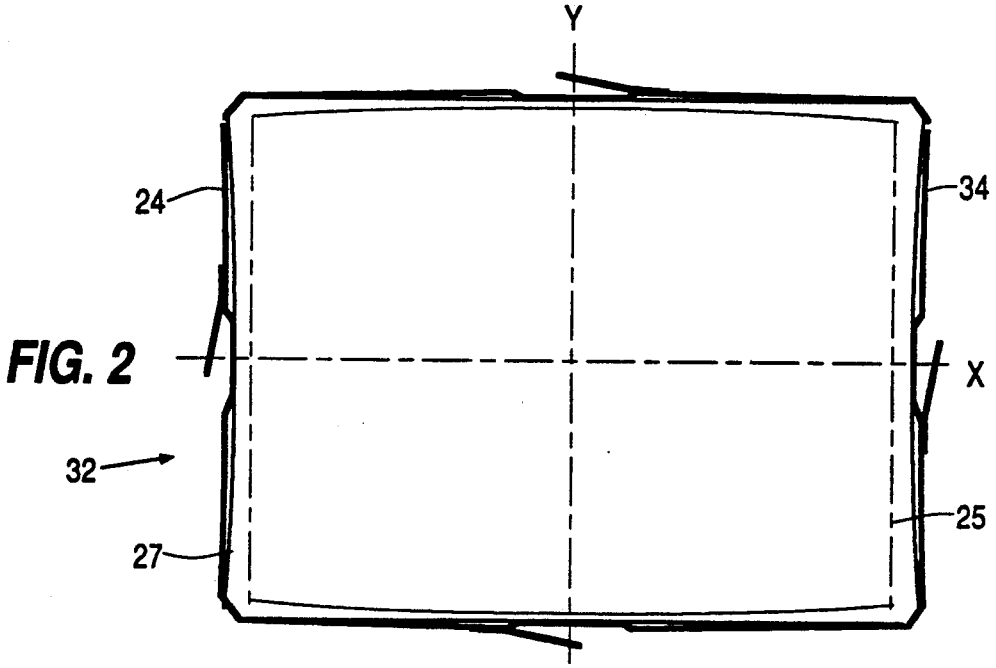
FIG. 2 is rear plan view of a mask-frame assembly of the tube of FIG. 1.
Figure 3:
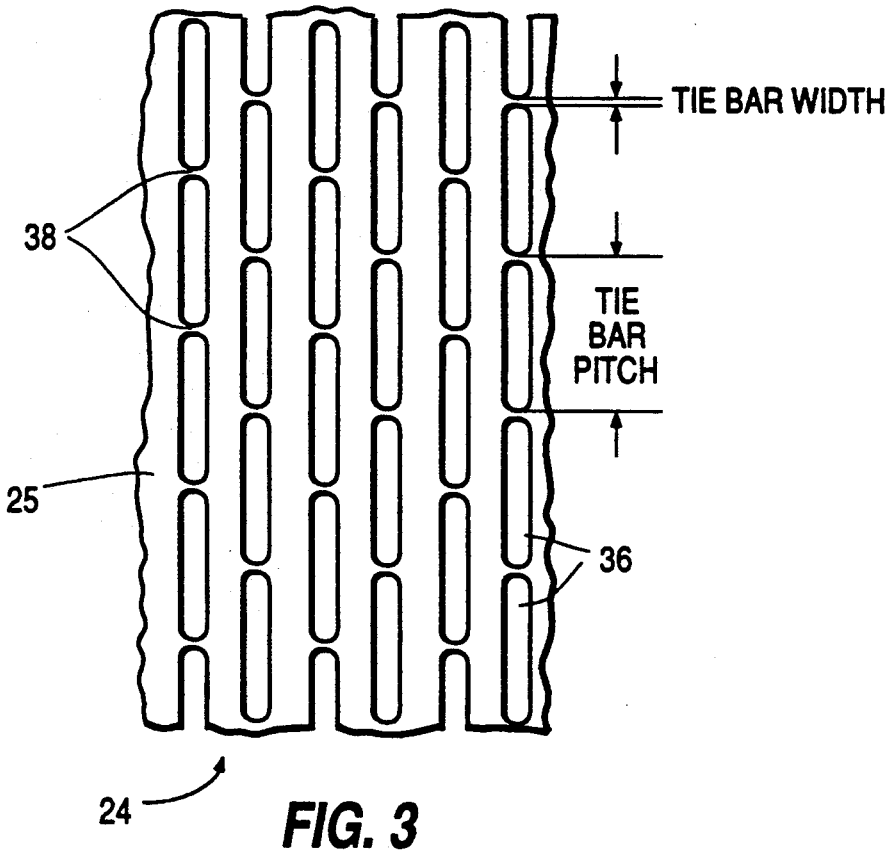
FIG. 3 is an enlarged view of a small portion of a shadow mask of the tube of FIG. 1.

The shadow mask 24, shown in greater detail in FIGS. 2 and 3, has a rectangular periphery with two long sides and two short sides. The mask 24 has a major axis X which passes through the center of the mask and parallels the long sides, and a minor axis Y which passes through the center of the mask and parallels the short sides. The mask 24 includes slit-shaped apertures 36 aligned in columns that essentially parallel the minor axis Y. Adjacent apertures 36 in each column are separated by tie bars 38 in the mask, with the spacing between tie bars 38 in a column being defined as the tie bar pitch at a particular location on the mask, as shown in FIG. 3. The vertical dimension of a tie bar, or tie bar width, is measured between adjacent apertures within a column.

A shadow mask is made from a flat sheet of metal, such as cold rolled steel or Invar (36% nickel steel), which is coated with a photosensitive film. The film is exposed through a photomaster which contains a photographic pattern of the desired aperture array. Next, the exposed portions of the film are removed and the metal sheet is etched to form an apertured flat shadow mask. The flat shadow mask is then placed in a press and formed into the desired shape of the final shadow mask. During this forming step, some portions of the mask stretch differently than other portions of the mask. Because the mask includes elongated apertures aligned in columns, wherein the apertures in each column are separated by tie bars, most of the stretching in the mask occurs in the tie bars. In an embodiment of the present invention, the widths of the tie bars are graded throughout the mask, in order to reduce mask stretching.

Figure 4:
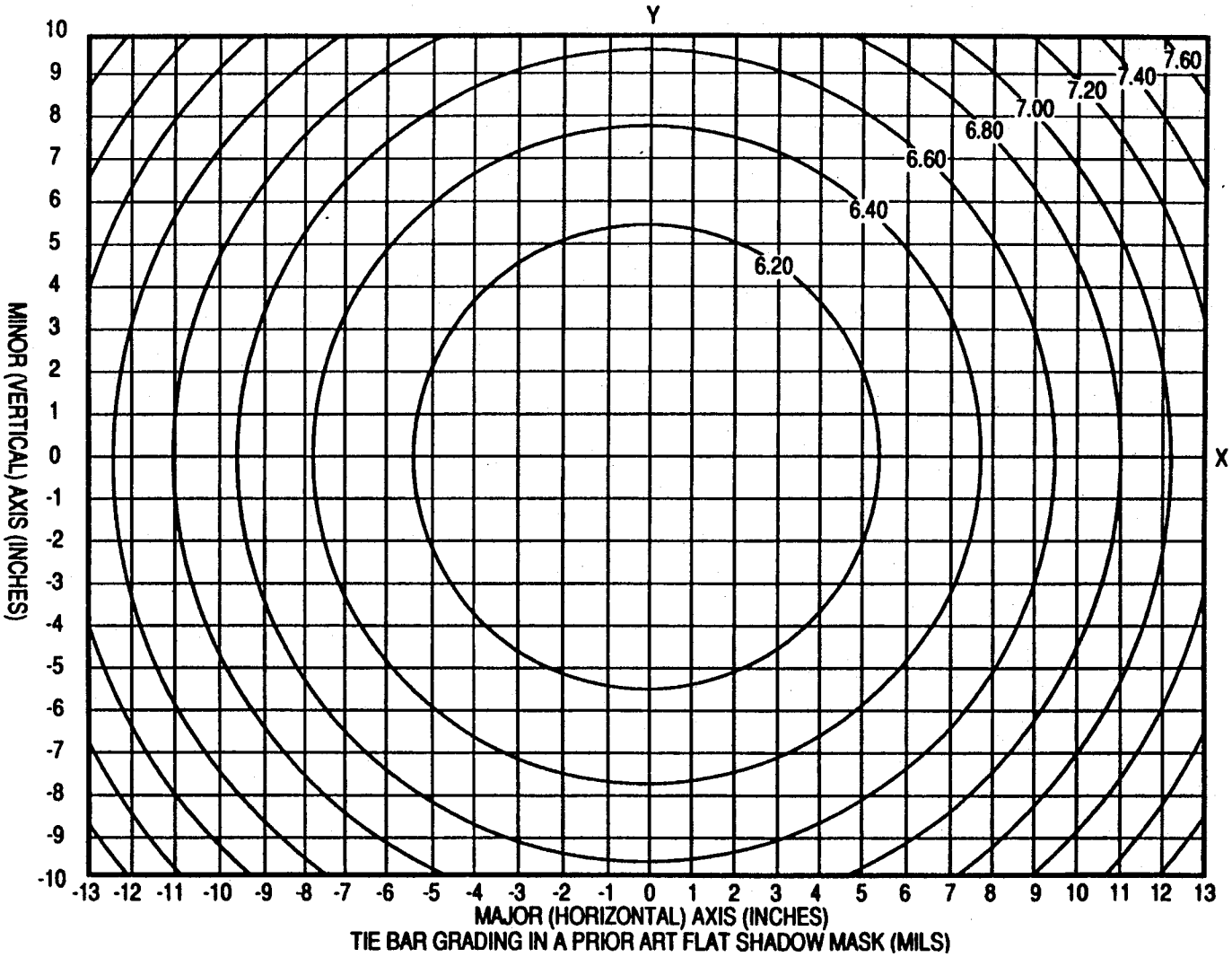
FIG. 4 PRIOR ART
FIG. 4 is a graph of tie bar width grading, measured vertically, in a prior art flat shadow mask.
Figure 5:
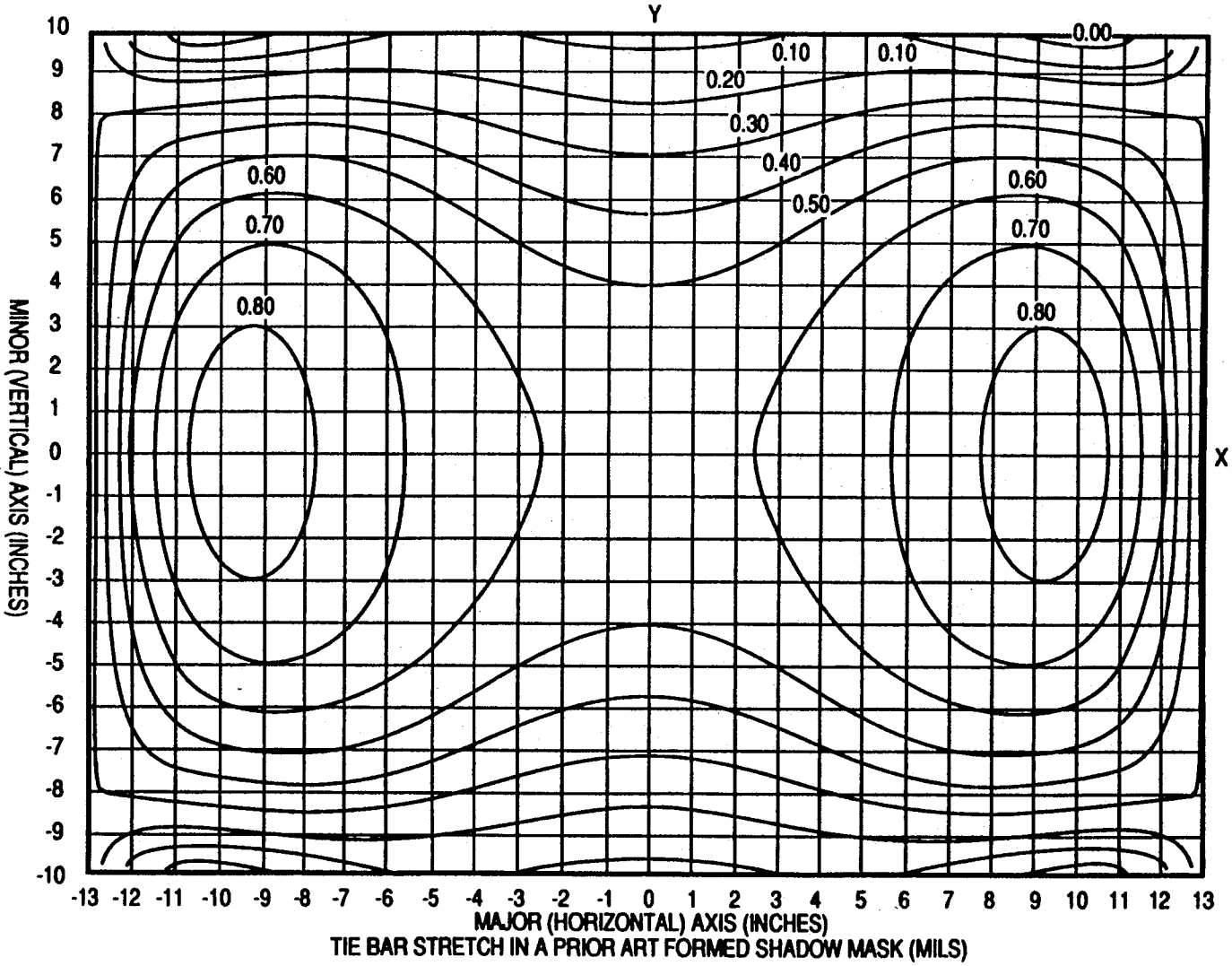
FIG. 5 PRIOR ART
FIG. 5 is a graph of tie bar stretch, measured horizontally, in a formed shadow mask having the tie bar width grading shown in FIG. 4.

FIG. 4 is a graph showing the grading of tie bar width in a prior art flat shadow mask for use in a tube having a 35-inch (88.9-cm) viewing screen diagonal dimension. Each closed curve in this graph indicates areas of equal tie bar width. The tie bar width grading, in this prior art mask, is circular. When the flat shadow mask of FIG. 4 is formed into its desired shape, the tie bars in the mask stretch in a pattern that is shown in the graph of FIG. 5. The stretch pattern has two areas of maximum stretch located near the ends of the major axis X and areas of minimum stretch located near the four corners of the apertured portion of the mask.

Figure 6:
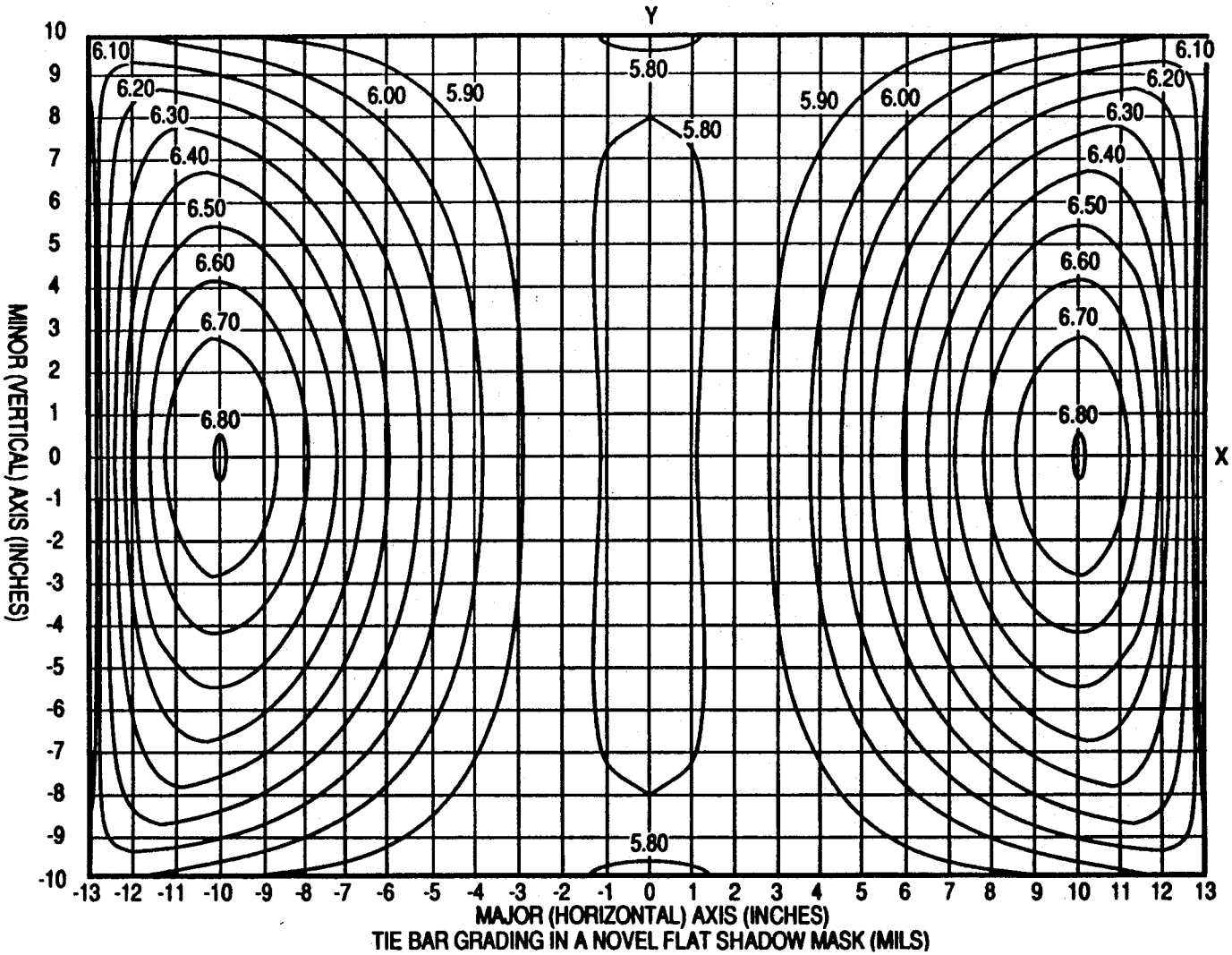
FIG. 6 is a graph of tie bar width grading in a flat shadow mask for a tube constructed according to the present invention.

In designing a shadow mask for a tube constructed in accordance with the present invention, the stretch pattern of FIG. 5 is used to determine which tie bars should be increased in width to increase their strength and thereby reduce their stretch during forming. The resultant grading for an improved novel flat shadow mask, that includes such compensation, is shown in FIG. 6 for a tube having a viewing screen diagonal of 35 inches (88.9 cm). In this improved mask, the tie bars near the short sides of the mask, along the major axis X, are given the maximum width to compensate for the maximum stretch occurring in the mask of FIG. 5. The grading pattern is nonradial between the center of the mask and the short sides of the mask, near the major axis X. The widths of the tie bars along the major axis X, in a direction from the center of the mask to the short sides of the mask, first increase in dimension to points between the center and the short sides and then decrease in dimension to the short sides.

Figure 7:
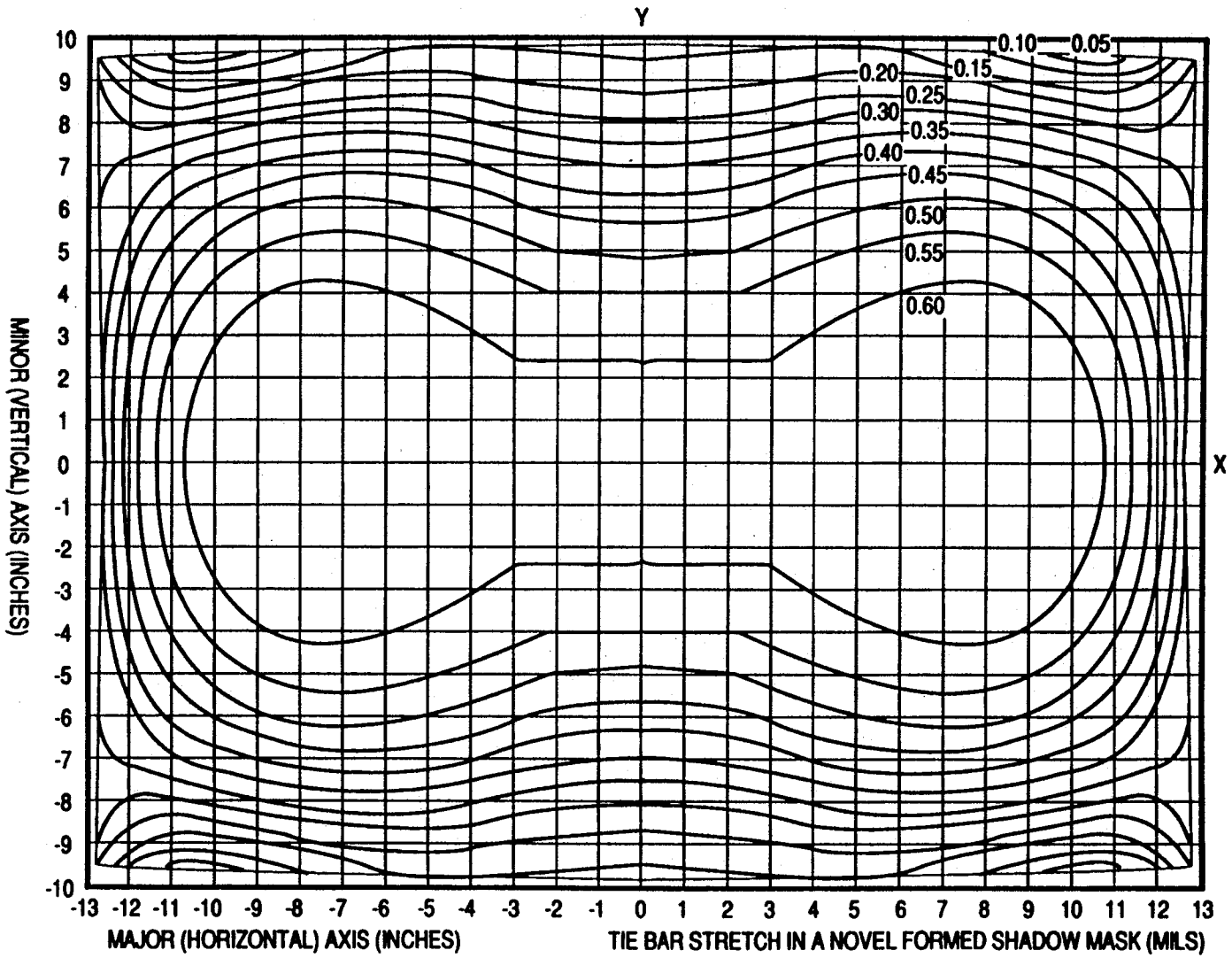
FIG. 7 is a graph of calculated tie bar stretch that is attained in a formed shadow mask having the tie bar width grading shown in FIG. 6.

When the mask of FIG. 6 is formed into the same desired shape as was the previous mask, the resultant tie bar stretch is such as shown in FIG. 7. In the formed mask of FIG. 7, the maximum stretch occurs in the center area of the mask. The largest stretch is about 0.60 mil, which is substantially less than the maximum stretch of 0.80 mil of the prior art mask shown in FIG. 5.

The tie bar width grading of the mask of FIG. 6 has not been optimized to values that would further reduce the maximum or peak stretch. A compromise was chosen because of a concern, for putting a large variation in the tie bar strength, in the event that a production tool did not perform as expected. Therefore, the stretch compensation provided by the tie bar grading pattern of FIG. 6 is only about half of what would be required for complete optimization. Although not shown in the present embodiment, the complete optimization or at least additional grading for approaching complete optimization is encompassed by the present invention.

What is claimed is:

1. In a color picture tube including a shadow mask which has a rectangular periphery with two long sides and two short sides, with a major axis passing through the center of said mask and paralleling said long sides and a minor axis passing through the center of said mask and paralleling said short sides, said mask including slit-shaped apertures aligned in columns that substantially parallel said minor axis, and adjacent apertures in each column being separated by tie bars in said mask, the widths of said tie bars being measured in a direction that substantially parallels said minor axis, the improvement comprising the widths of said tie bars located along said major axis, in a direction from the center of said mask to the short sides of said mask, first increasing in dimension, to points between the center and the short sides, and then decreasing in dimension to the short sides.

* * * * *